US005752723A

United States Patent [19]

Robertson

[11] Patent Number: 5,752,723

[45] Date of Patent: May 19, 1998

[54] PHARMACY LABEL AND PRESCRIPTION DRUG DISPENSING

[76] Inventor: Chad Robertson, c/o 5000 Executive Pkwy, Suite 200, San Ramon, Calif. 94583

[21] Appl. No.: 806,953

[22] Filed: Feb. 26, 1997

[51] Int. Cl.[6] ..... B42D 15/00

[52] U.S. Cl. ..... 283/67; 283/81; 283/900

[58] Field of Search ..... 283/67, 70, 80, 283/81, 163, 105, 900; 40/299, 310, 625, 630

[56] References Cited

U.S. PATENT DOCUMENTS

| | | | |
|---|---|---|---|
| 4,159,129 | 6/1979 | Lockhart . | |
| 4,277,902 | 7/1981 | Miniaci | 283/80 |
| 4,372,681 | 2/1983 | Sallenbach | 283/900 |
| 4,621,837 | 11/1986 | Mack | 283/105 |
| 4,666,185 | 5/1987 | Pilborough | 283/80 |
| 4,674,771 | 6/1987 | Thompson, II | 283/81 |
| 4,706,996 | 11/1987 | Fasham | 283/900 |
| 4,976,351 | 12/1990 | Mangini et al. | 206/232 |
| 5,048,870 | 9/1991 | Mangini et al. | 283/81 |
| 5,435,600 | 7/1995 | Griffiths et al. | 283/81 |
| 5,601,314 | 2/1997 | Burns et al. | 283/81 |

*Primary Examiner*—Willmon Fridie, Jr.
*Attorney, Agent, or Firm*—Nixon & Vanderhye P.C.

[57] ABSTRACT

A pharmacy label construction is provided that allows practice of a method of dispensing prescription drugs that takes a pharmacist or doctor less than a third of the time normally required to properly label a package of prescription drugs at a pharmacy or hospital. A label assembly includes a release liner having first and second ends, and supporting a first label section located adjacent the first end, a second label section located adjacent the second end, and at least one central label section located between the first and second sections, each section having pressure sensitive adhesive engaging the release liner. In practice of the method of dispensing the steps are: imaging the first label section to include indicia comprising the name of a prescription drug, the dosage for proper administration of the drug, and the quantity of the drug to be provided in a package; exposing the adhesive of the first label section at two widely spaced areas while leaving the release liner in place between the spaced areas; folding the second and central label sections, while attached to the release liner, underneath the release liner at the first label section; attaching the exposed adhesive areas of the first label section to a package for the drug; at a pharmacy, hospital, etc., detaching at least part of the first label section from the package; applying prescribing doctor and patient name indicia to both the first, and second or central, label sections; detaching the central and second label sections from the first label section; removing the release liner from the first label section to expose most or all of the adhesive on the first label section; and applying the first label section exposed adhesive to the package.

20 Claims, 5 Drawing Sheets

PHARMACY LABEL AND PRESCRIPTION DRUG DISPENSING

BACKGROUND AND SUMMARY OF THE INVENTION

Prescription drugs are widely dispensed at pharmacies, hospitals, clinics, or other locations. The average time that it takes to fill a prescription is between two-four minutes, and can in a day consume a large part of a pharmacist's or doctor's time that could be better spent in other endeavors. Many systems have been proposed for making the dispensing of prescription drugs easier or quicker, but none have been fully successful in significantly reducing the time necessary to fill a prescription while still ensuring the appropriate level of accuracy and record keeping.

According to the present invention a method, label assembly, and label prescription drug package, are provided which successfully reduce the time necessary to accurately and appropriately (with proper record keeping) fill a prescription. According to the present invention the average time to fill a prescription is reduced to less than a third of the conventional time, e.g. from between about two-four minutes to about thirty seconds, without compromising accuracy or record keeping, and with a minimum of cost. These advantages are achieved according to the present invention by providing a particularly constructed label assembly which can be easily applied, removed, and reapplied (without sacrificing integrity) to a package (such as a vial, tube, bottle, etc.) containing a prescription drug, and by applying the appropriate drug, dosage, and quantity information at the distributor level so that it need not be applied by the doctor at the point in which the drug is dispensed to the patient.

According to one aspect of the present invention a method of dispensing prescription drugs, using a label assembly including a release liner having first and second ends, and supporting a first label section having pressure sensitive adhesive engaging the release liner and located adjacent the first end, a second label section having pressure sensitive adhesive engaging the release liner and located adjacent the second end, and at least one central label section having pressure sensitive adhesive engaging the release liner and located between the first and second sections, is provided. The method comprises the steps of: (a) Imaging the first label section to include indicia comprising the name of a prescription drug, the dosage for proper administration of the drug, and the quantity of the drug to be provided in a package. (b) Exposing the adhesive of the first label section at two areas thereof widely spaced between the release liner first and second ends while leaving the release liner in place between the two widely spaced areas. (c) Folding the second and central label sections, while attached to the release liner, underneath the release liner at the first label section. (d) Attaching the exposed adhesive areas of the first label section to a package for the drug, to be administered at the dose, and having the quantity, applied to the first label section in step (a), so that the entire label assembly is positioned on the package. (e) Detaching at least part of the first label section from the package. (f) Applying prescribing doctor and patient name indicia to the first label section and at least one of the second and central label sections. (g) Detaching the central and second label sections from the first label section. (h) Removing the release liner from the first label section to expose most or all of the adhesive on the first label section. And, (i) applying the first label section exposed adhesive to the package and dispensing the package.

The method typically comprises the further steps of removing the release liner from the second label section or at least one central label section, and adhesively applying at least one of them to a record sheet. Steps (d) and (i) may be practiced using a vial as the package, or any other conventional container for drugs whether the drug be in tablet, capsule, liquid, cream, or gel form. There is also typically the further step, between steps (d) and (e), of shipping the package to a pharmacy, hospital, or other drug dispensing facility, and steps (e) through (i) are practiced at the pharmacy, hospital, or other drug dispensing facility.

The second or central label section may include a self-contained coating, and step (f) may be practiced by impressing indicia on the first label section, which is transferred to the self-contained coating and is thus simultaneously provided on the self-contained coating. The first label section may have a thermosensitive coating, in which case step (a) is practiced using a conventional thermal printer on the thermosensitive coating. Typically, before step (a), there is a step of imaging (e.g. when the label assemblies are originally made) indicia calling for the entry of doctor and patient name on both the first and at least one of the second and central label sections, as well as other indicia such as "Receipt", "Log", "Chart", or the like. Step (c) is practiced to position the indicia calling for entry of doctor and patient name on the second or central label section aligned with and beneath the indicia calling for the entry of doctor and patient name on the first label section. The label assembly may be part of a web, and the release liner may have tractor drive holes adjacent the first and second ends thereof, in which case step (a) may be practiced by driving the web through a printer using the tractor drive holes.

According to another aspect of the present invention, a label assembly is provided comprising the following components: A release liner elongated in a first dimension and having first and second ends. A first label section having pressure sensitive adhesive engaging the release liner and located adjacent, but spaced from, the release liner first end, the first label section also having first and second ends, the first end the closest portion of the first label section to the release liner first end. A second label section having pressure sensitive adhesive engaging the release liner and located adjacent, but spaced from, the release liner second end. At least one central label section having pressure sensitive adhesive engaging the release liner and located between and distinct from the first and second label sections. And, a readily separable end strip portion of the first label section at the first label section first end.

The label assembly may further comprise indicia comprising the name of a prescription drug, the dosage for proper administration of the drug, and the quantity of the drug to be provided in a package, imaged on the first label section. A fold line may be provided between the second label section and the at least one central label section, or between two central label sections, and the second label section and the central label section (and/or the two central label sections) are spaced from each other in the dimension of elongation. The at least one central label section may comprise two label sections, e.g. labeled "Log" and "Chart", while the second end section is labeled "Receipt". The first label section may have any other suitable indicia thereon such as cautions indicating that Federal law prohibits transfer of the packaged medication to any person other than the patient for whom it has been prescribed, storage instructions, legal disclaimers, manufacturer's name or logos, etc. All such indicia is preprinted on the label assembly.

The label assembly may further comprise indicia calling for entry of doctor and patient name on both the first and second or central label sections, the indicia on the first and second or central sections aligned with each other when the release liner is Z-folded, including at a fold line. A thermosensitive coating is preferably provided on the first label section, and the release liner is typically part of a web of substantially identical release liners parallel to and adjacent each other, with lines of weakness (such as perforations) disposed between the release liners. Tractor drive holes may be disposed in the release liner adjacent the first and second ends thereof and between the first label section and the first end of the release liner, and the second label section and the second end of the release liner, respectively. Because of the readily separable end strip portion (often called a "zip strip") the pressure sensitive adhesive may be permanent type adhesive to ensure integrity of the package label, although in some circumstances removable or repositional pressure sensitive adhesive may be used on some or all parts of the label sections.

According to another aspect of the present invention a label prescription drug package is provided comprising the following components: A release liner elongated in a first dimension and having first and second ends. A first label section having pressure sensitive adhesive engaging the release liner and located adjacent, but spaced from the release liner first end. A second label section having pressure sensitive adhesive engaging the release liner and located adjacent, but spaced from the release liner second end. At least one central label section having pressure sensitive adhesive engaging the release liner and located between and distinct from the first and second label sections. Indicia comprising the name of a prescription drug, the dosage for proper administration of the drug, and the quantity of the drug to be provided in a package, imaged on the first label section. A package containing the quantity of and the type of drug indicated by the indicia. And, the label first section secured by two widely spaced areas of adhesive to the package with the second and central label sections folded underneath the first label section release liner and disposed between the package and the first label section.

Indicia calling for entry of doctor and patient name is preferably provided as described above, and a thermosensitive coating may be provided on the first label, the indicia indicating the name of the prescription drug, etc., imaged in the thermosensitive coating. The package is preferably a vial but may comprise a bottle, box, tube, or other container for prescription drugs whether in tablet, capsule, liquid, cream, or other conventional form.

It is the primary object of the present invention to provide for the accurate, quick, and cost effective dispensing of prescription drugs, and proper and simple record keeping therefor. This and other objects of the invention will become clear from an inspection of the detailed description of the invention and from the appended claims.

BRIEF DESCRIPTION OF THE DRAWINGS

FIG. 6 is a perspective schematic view showing the removal of the label assembly from the package of FIG. 5 at the dispensing point so as to separate the various label sections and apply them to a package, record sheet, or the like.

DETAILED DESCRIPTION OF THE DRAWINGS

Figure 1:
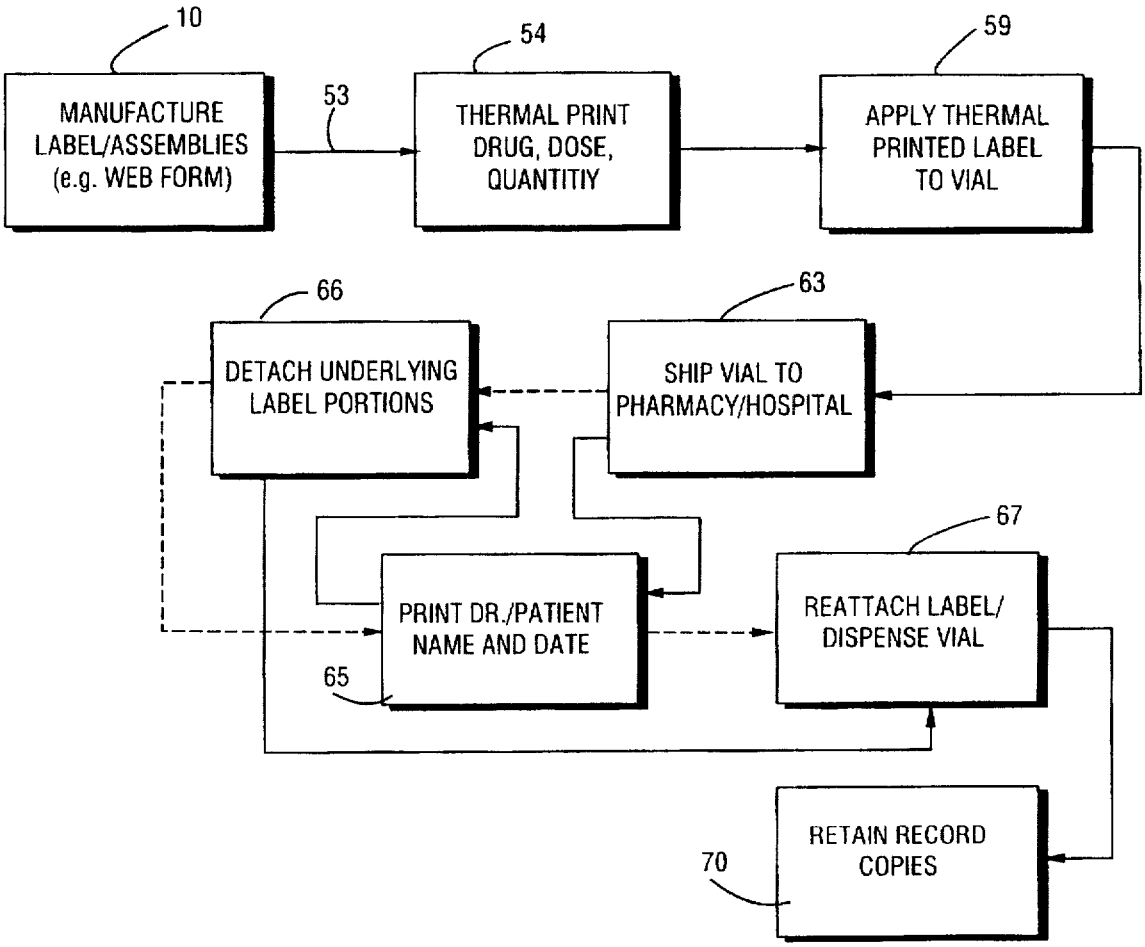
FIG. 1 is a diagrammatic view of an exemplary method according to the present invention.

FIG. 1 schematically illustrates exemplary method steps that may be practiced according to the method of the present invention. Various structures of the label assembly according to the present invention, for producing a labeled prescription drug package according to the present invention, will be described with respect to FIGS. 2–7 when setting forth the details of the method steps of FIG. 1.

Label assemblies, typically in web form, are manufactured—as indicated by box 10 in FIG. 1—at a label manufacturing facility. A typical portion of a web of labels, which is formed into a sheet containing a plurality of label assemblies (three in the embodiment of FIG. 2), is shown generally by reference numeral 11 in FIG. 2. The web 11 of label assemblies of FIG. 2 includes the individual label assemblies 12 with a release liner 13 comprising the basic web material, and with lines of weakness—such as perforations 14—disposed between each of the label assemblies 12 in liner 13. The release liner 13 is of conventional construction, typically having a silicone coating on the top face (the face seen in FIG. 2) thereof.

Each label assembly 12 release liner 13 has a first end 15 and a second end 16, and is elongated in dimension 17 between the ends 15, 16. The ends 15, 16 are substantially parallel to each other and substantially perpendicular to the lines of weakness 14. In order to facilitate manufacture of the label assemblies 12, and also to facilitate use of the label assemblies 12 in other equipment at an indicia applying location, tractor drive holes 18 may be provided in the release liner 13 adjacent the ends 15, 16.

Figure 2:
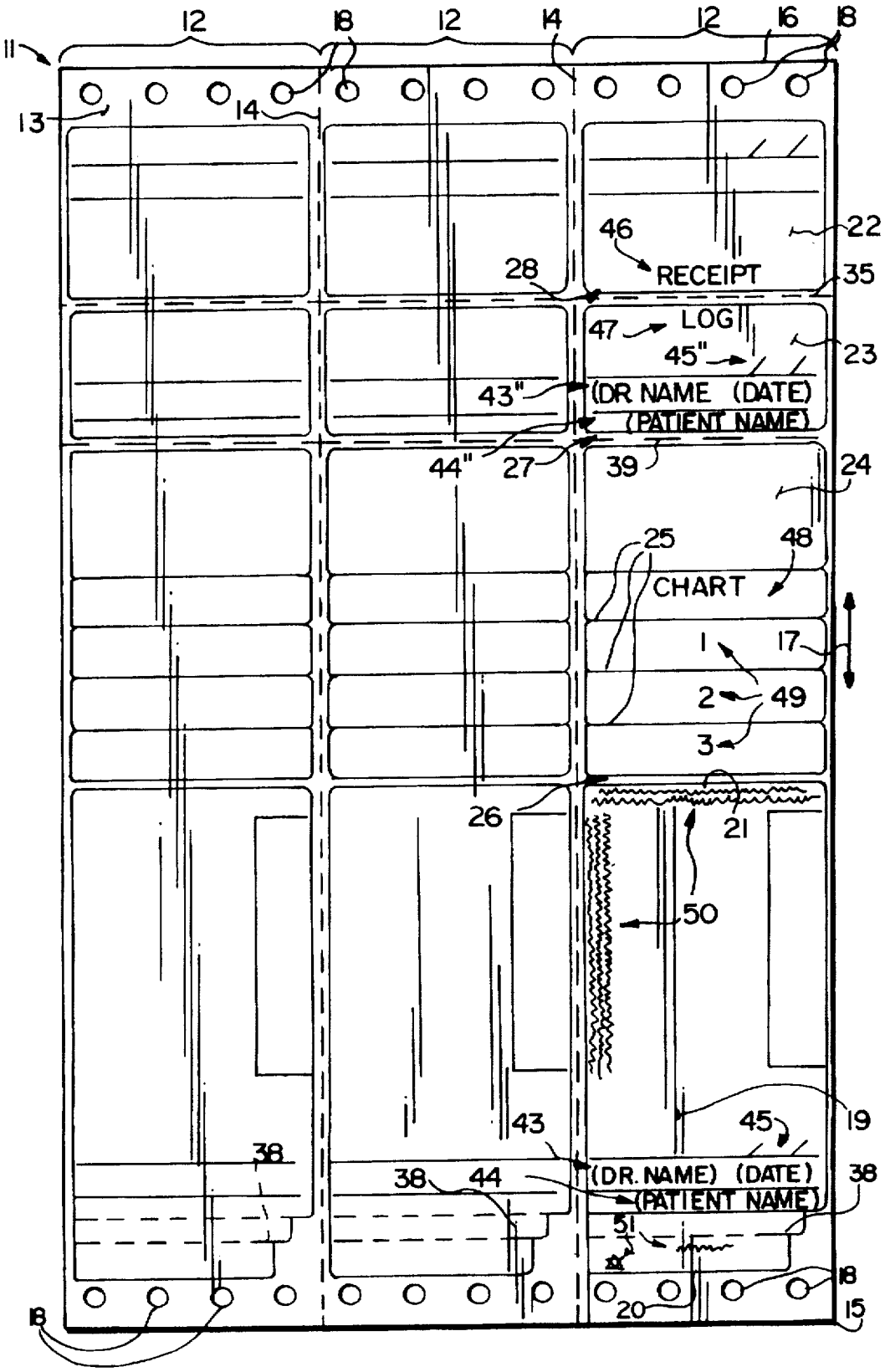
FIG. 2 is a top plan view of a web of label assemblies according to the present invention.

At the manufacturing facility, indicated schematically at by 10 in FIG. 1, various indicia are imaged on label sections associated with each of the label assemblies 12, and the individual label sections are formed, e.g. by die cutting, blow on, etc. The label assemblies 12 each preferably comprise a first label section 19 adjacent the first end 15 of the release liner 13, and having first and second ends 20, 21 thereof, respectively; a second label section 22 adjacent, but spaced from, the second end 16 of the release liner 13; and at least one central label section. In the embodiment in FIG. 2, two different central label sections 23, 24 are provided, and in fact the central label section 24 is actually defined by die cut or lines of weakness 25 into a number of different portions. As seen in FIG. 2 in the preferred embodiment the various label sections 19, 22, 23 and 24 are actually spaced from each other in the dimension of elongation 17, as seen by the exposed underlying release liner 13 at gap 26 between the label sections 19, 24, at gap 27 between the label sections 24, 23, and at gap 28 between the label sections 22, 23. While the gaps 26–28 are preferred, in some cases the ends of the sections 19, 22–24, may touch (although separated by die cut lines, or lines of weakness).

Each of the label sections 19, 22–24 includes a substrate and pressure sensitive adhesive, as well as potentially other coatings. A schematic illustration of these various layers and coatings is provided in FIG. 3. While FIG. 3, for simplicity of illustration, merely shows the construction of the first and second label assemblies 19, 22, it is to be understood that the central label sections 23, 24 have comparable constructions.

Figure 3:
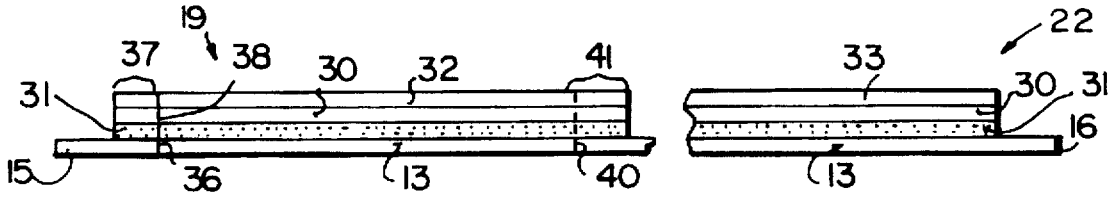
FIG. 3 is a side schematic view, greatly enlarged for clarity of illustration, showing the various layers of the label assembly of FIG. 2.

As seen in FIG. 3 the first label section 19 includes a substrate 30 which typically is of paper, but also may be of a conventional synthetic material such as an opaque plastic film (preferably one that is tearable), or the like. To the bottom surface of substrate 30 is applied (with or without a tie coat) a pressure sensitive adhesive 31. Preferably the pressure sensitive adhesive 31 is a conventional permanent pressure sensitive adhesive, but under some circumstances it, or portions of it, may comprise a conventional repositional or removable pressure sensitive adhesive. Provided on the opposite surface of the substrate 30 from the pressure sensitive adhesive 31, with or without a tie coat, preferably is the thermosensitive layer 32. The thermosensitive layer 32 is of conventional construction (and typically the substrate 30 with the coating 32 is a purchased item to which the adhesive 31 and release liner 13 are applied), and is capable of forming an image when a conventional thermal printer printhead is brought into contact therewith.

The second label section 22 also includes a substrate 30 and pressure sensitive adhesive 31, but instead of a thermal coating 32 a conventional self-contained carbonless coating 33 may be provided which forms an image on the top face of the substrate 30 when impacted with a pen, typewriter stylus, or other mechanical implement.

At the manufacturing stage 10 various other score lines, lines of weakness, fold lines, and the like are provided in each of the label assemblies 12. In the preferred embodiment illustrated in the drawings for example a first fold line 35 (see FIGS. 2, 4, and 6) is provided at the gap 28 between the second label section 22 and the central label section 23, and a second fold line 36 (see FIGS. 3, 4, and 6) is provided adjacent, but spaced from, said first end 15 of said release liner 13.

Figure 4:
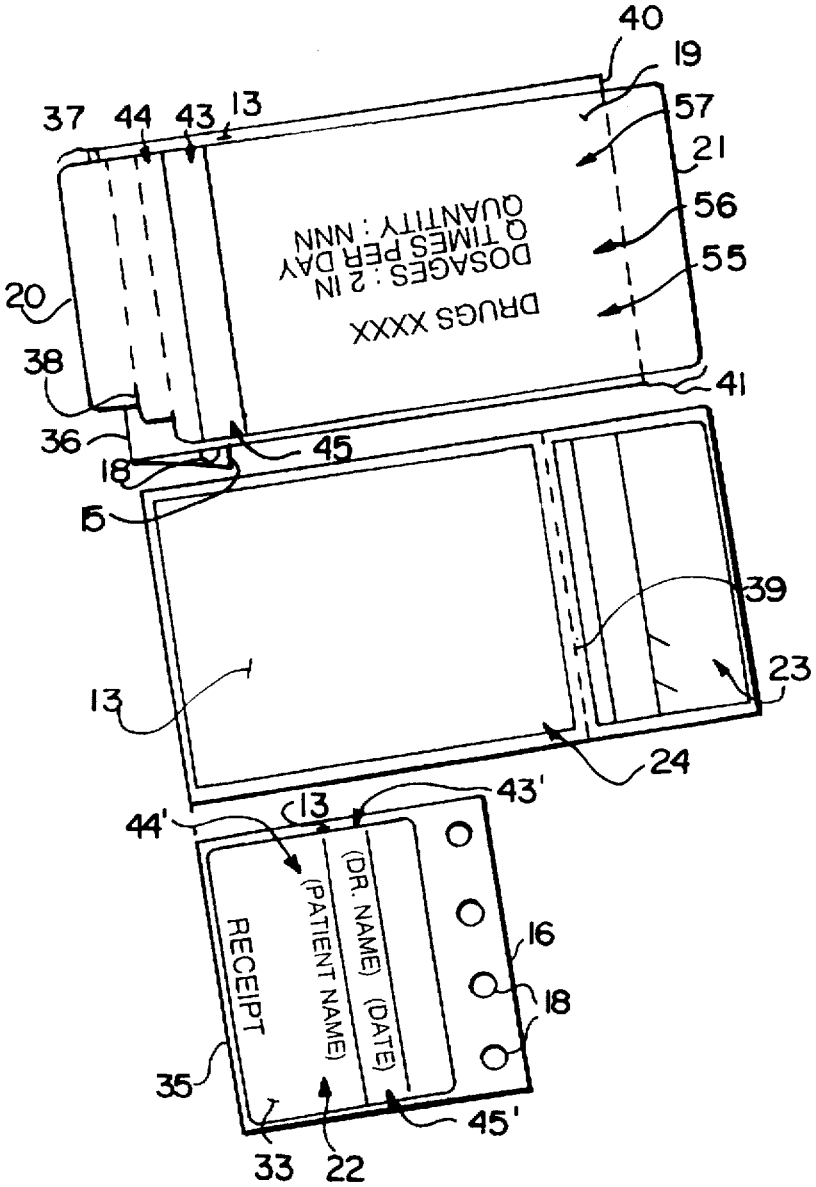
FIG. 4 is an exploded view showing the various sections of the label assembly of FIGS. 2 and 3 when Z folded to initially be disposed on a package, such as a vial.

A readily separable end strip portion 37 (see FIGS. 3, 4, and 6) is preferably also provided as part of the first label section 19 at the first end 20 thereof. This readily removable end section 37 may be formed by providing a cut line 38 (see FIGS. 2–4) in the substrate 30 which allows one to start easy tearing of the substrate 30 of the first label section 19 when the end section 37 is grasped at the cut line 38 and pulled back. That is the end portion 37 may be what is commonly called a "zip strip". Other ways of forming the end section 37 are to provide a fairly strong line of weakness (such as a perforation line), a relatively deep score line, or other conventional configuration. Note that the second fold line 36 is approximately aligned with the cut line 38 so that when the portion of the release liner 13 between the first end 15 and the cut line 36 is folded back (as seen in FIG. 4) the adhesive 31 on the bottom of the portion 37 is exposed.

Note that the fold line 35 preferably comprises a line of weakness so that the release liner 13 with the second label section 22 thereon may be detached from the rest of the release liner 13. Also another fold line that is a line of weakness, 39 (see FIGS. 2, 4, and 6), may be provided between the central label sections 23, 24 at the gap 27 (see FIG. 2). A third fold line, e.g. a line of weakness, 40 (see FIGS. 4 and 6) may also be provided adjacent, but spaced from, the second end 21 of the first label section 19 to provide a second end section 41 of the first label section 19 that can have exposed adhesive while the rest of the release liner 13 covers the majority of the pressure sensitive adhesive 31 of the first label section 19.

At the label assembly manufacturing stage 10 various indicia is also preferably printed, or otherwise applied, to the label sections. The indicia can be applied before the thermosensitive coating 32 and self-contained coating 33 are applied, or may be applied directly over them using conventional imaging techniques. This, non-variable, indicia preferably includes—as seen most clearly in FIGS. 2, 4, and 6—on the first label section 19, indicia 43 calling for the entry of a doctor name, indicia 44 calling for entry of a patient name, and indicia 45 calling for entry of a dispensing date. On the second label section 22 the same indicia is applied, namely the doctor name indicia 43', patient name indicia 44', and date indicia 45'. The indicia 43–45 and 43'–45', in relationship to the other components, may be aligned so that when the release liner 13 is folded about the fold lines 35, 40 (see FIG. 5), they have the same orientation and are aligned with the indicia 43 directly above the indicia 43', etc. This allows the doctor's name handwritten at the indicia 43 to be transferred to the self-contained coating 33 at the indicia 43'.

Various other indicia may also be applied, for example the background (e.g. light blue) indicia (see FIG. 2) "Receipt" 46, "Log" 47, "Chart" 48, various numbers 49, etc. Also the doctor name, patient name, and date indicia 43", 44", 45" may also be provided on the "Log" central section 23, and various cautions regarding Federal law prohibiting transfer of the medication, storage instructions, or the like may be printed as indicated at 50 in FIG. 2, as well as the manufacturer's distributor's name or logo 51. If desired a self-contained carbonless coating 33 may be provided on section 23, and the components constructed so that the release liner when folded as in FIG. 7 places indicia 43"–45" directly underneath indicia 43–45.

Figure 6:
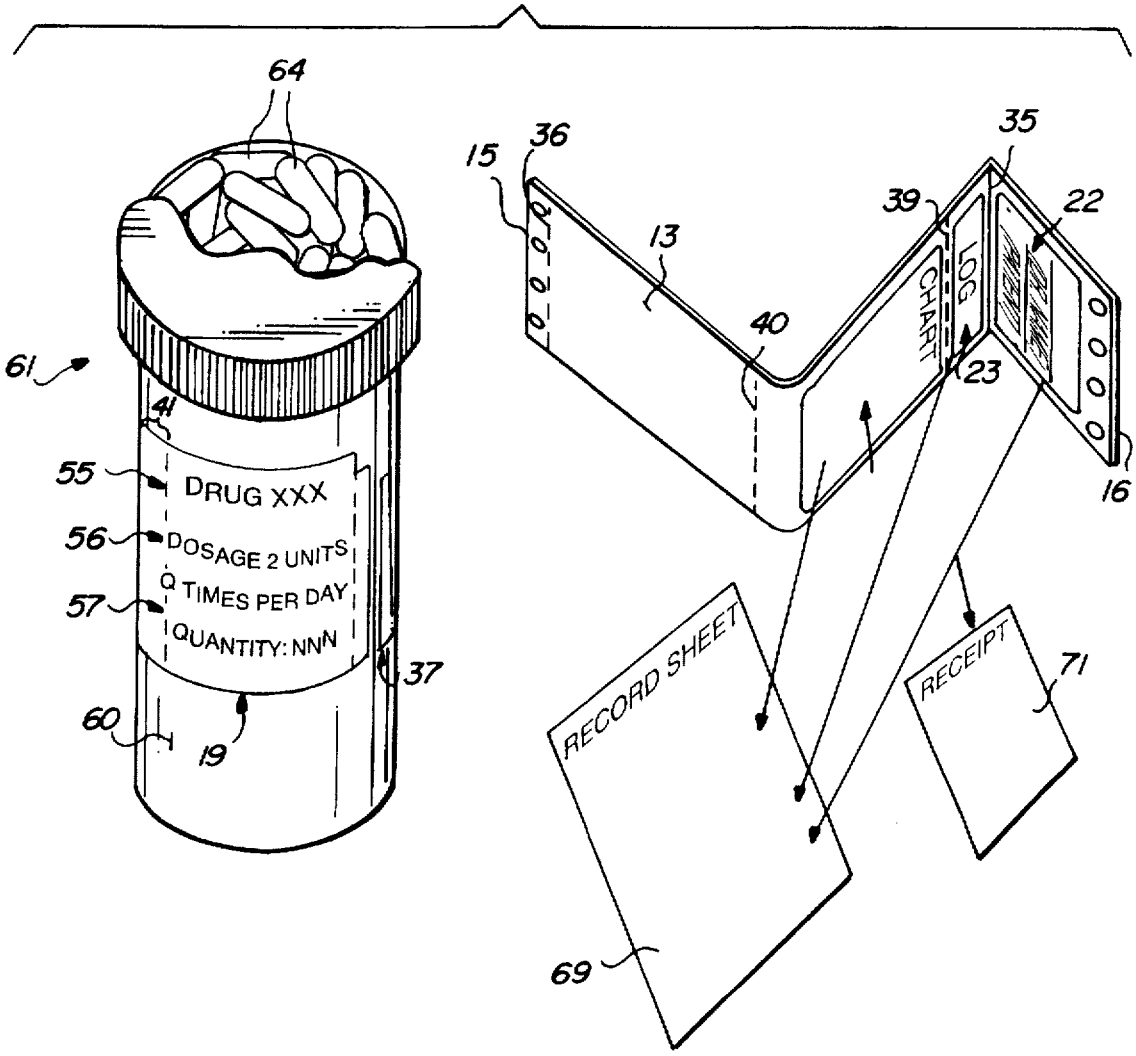

After the manufacture of the label web 11, it is put in sheet or roll form, and is shipped, as indicated by arrow 53 in FIG. 1, to a drug distributor or manufacturer, who will apply further indicia to the label assemblies 12, and will produce a labeled prescription drug package according to the invention. As indicated by box 54 in FIG. 1, typically the web 11 using the tractor drive holes 18 will be fed through a conventional thermal printer to form indicia on the thermal coating 32 of the label section 19. As seen in FIGS. 4 and 6, the indicia formed on the first label section 19 includes the name of the drug with which the label assembly 12 will be associated, this indicia indicated generally by reference numeral 55 in FIGS. 4 and 6, the dosage indicia 56, and quantity indicia 57.

The drug indicia 55 may be the generic name of the drug and/or its trademark or trade name, with or without the labeling indicia "Drug". For the example illustrated in FIGS. 4 and 6 the dosage is indicated as "Z" units "Q" times per day (e.g. two tablets, two times per day, or one application to affected area three times per day, etc.), but any appropriate dosage indicia for the particular drug being dispensed may be provided, with or without the labeling indicia "Dosage". The indicia 57 may be expressed in any conventional form such as number of units, weight, volume, etc. (e.g. "100 tablets", "200 ml. liquid", etc.), with or without the labeling indicia "Quantity".

Figure 5:
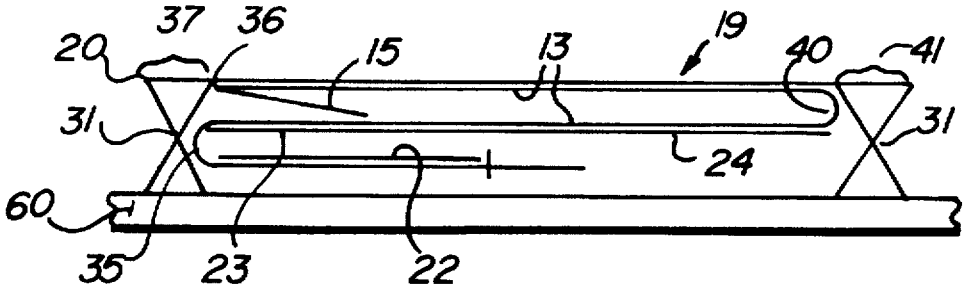
FIG. 5 is a diagrammatic side view of the label assembly, when Z folded as illustrated in FIG. 4, shown disposed on a package wall, the package wall being shown in straight line merely for clarity of illustration.

After thermal printing at stage 54, the label assembly 12 is separated, at a perforation line 14, from the adjacent label assembly 12 of the web 11, and that thermal printed label assembly 12 is then applied to a package (container) for the drug as illustrated schematically at stage 59 in FIG. 1. FIG. 5 schematically illustrates one embodiment of this application to the exterior 60 of a vial 61 (see FIG. 6). In FIG. 5 the exterior 60 is shown disposed linearly for clarity of illustration, but as is clear from FIG. 6 the vial 61 surface 60 is actually curved. Any package conventionally used for packaging drugs may, of course, be utilized as package 61, such as a tube, cardboard box, bottle, etc.

Figure 7:
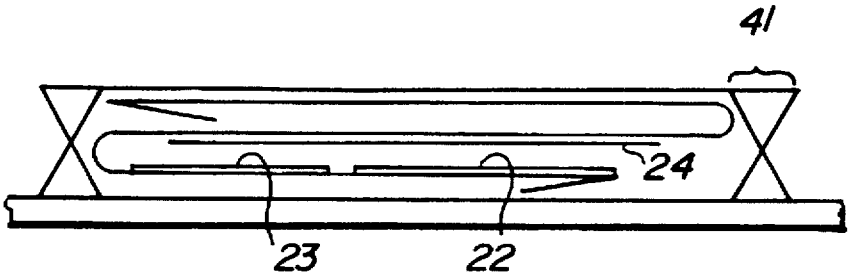
FIG. 7 is a view like that of FIG. 5 of an alternative embodiment.

The label assembly 12 is applied to the package surface 60 by bending the release liner 13 at fold line 36 to expose the adhesive 31 under the readily separable end strip portion 37 of the first label section 19, and folding at fold line 40 to expose the adhesive 31 beneath the end section 41 of first label section 19. Between these widely spaced two exposed adhesive portions the liner 13 is intact. The rest of the liner 13 is Z folded, as illustrated in FIG. 5, by folding at the fold line 35, so that the indicia 43, 43', etc. of the label sections 19, 22, respectively, are aligned. Alternatively, if the fold line 40 is located closer to the first end 15 than as illustrated in FIG. 5, and the rest of the components are appropriately positioned, the indicia 43", etc., on the central section 23 may be disposed in alignment with the indicia 43, etc., on the first label section 19, as illustrated in FIG. 7. In this case the self-contained coating 33 will be provided on the top of the substrate 30 of the label section 23.

After the label assembly 12 is applied to an appropriate package 61 surface 60, as illustrated in FIGS. 5 or 7, the package 61 having the drug and quantity indicated by the indicia 55, 57, and for normal application at the dosage indicated by indicia 56, the package 61 is shipped to a pharmacy, hospital, or other dispensing point, as indicated by stage 63 in FIG. 1. At the pharmacy, hospital, or other distribution point the drug—illustrated schematically by the pills 64 in FIG. 6—may be quickly dispensed, i.e. a prescription therefor quickly filled.

Rather than taking between two-four minutes to fill the prescription, the prescription for the drug 64 in the vial 61 may be filled in about thirty seconds. This is because the drug, dosage, and quantity indicia 55–57 are already provided on the label section 19, therefore the pharmacist or doctor need only reach for the vial 61, hand write the doctor's name at the indicia 43, the patient's name at the indicia 44, and the dispensing date at the indicia 45 (which are automatically transferred to the indicia areas 43'–45', or 43"–45", respectively), and detach the label portions 22–24. This handwriting of the doctor's name, etc. is illustrated schematically by box 65 in FIG. 1, while the detachment of the underlying label portions 22–24 is illustrated at stage 66 in FIG. 1.

The stage 66 is preferably practiced by removing the "zip strip" 37 from the rest of the first label section 19, as illustrated in FIG. 6. In view of the cut line 38 the rest of the label section 19 readily separates from the zip strip 37 while the adhesive 31 underlying the portion 41 of the first label section 19 remains in secure attachment with the exterior surface 60 of the package 61. This allows access to the first end 15 of the release liner 13, and by pulling on the release liner 13 most (preferably all) of the adhesive 31 under the entire label section 19 is exposed. The release liner 13, with the still attached label sections 22–24, is also completely removed from underneath the first label section 19, as illustrated in FIG. 6. The label section 19 is then readily and permanently applied to the surface 60 of the package 61 merely by pushing the pressure sensitive adhesive 31 underlying the main body of the section 19 into contact with the surface 60. This reattachment step is illustrated schematically at 67 in FIG. 1.

The label sections 22–24 are then used for any desired purpose. Typically in order to provide legal documentation one of the sections 22, 23 is applied to a record sheet 69 (see FIG. 6) or the like. This is illustrated schematically at 70 in FIG. 1. The sections 22, 23 can be applied to different log sheets, or—in the embodiment of FIG. 7—the section 23 is removed from the release liner 13 and the adhesive 31 thereof is applied to the record sheet 69 while the label section 22 is either discarded or removed from the release liner 13 and applied to a receipt 71 that the patient takes with him or her, which receipt 71 includes the cost of the drug 64. In this case the doctor name, patient name, and dispensing date are handwritten on the section 22 at the indicia 43'–45', respectively, before or after it is applied to the receipt 71. The section 24 may be applied to the record sheet 69, or to a different record sheet, or put to any other desired use of the pharmacy, doctor, or the like, to facilitate record keeping.

Alternatively, if it is inconvenient or undesirable to use the self-contained coating 33 on either of the label sections 22 or 23, as illustrated by the dotted line in FIG. 1 the label assembly 12 may first be detached from the package as illustrated at stage 66 in FIG. 1, and then the doctor and patient names and the date may be separately printed on the section 19 and one or both of the sections 22 and 23, as illustrated at stage 65 in FIG. 1, and then stage 67 practiced. If the assembly is designed to be used in this manner no self-contained coating 33 is necessary on any label section, and the substrates 30 of all sections 22–24 may be uncoated, or coated with a thermally sensitive material, or other conventional coating material.

It will thus be seen that according to the present invention a method of dispensing prescription drugs (filling a prescription), a label assembly facilitating practice of the method, and a labeled prescription drug package (61, as seen in any one of FIGS. 5 through 7), have been provided which are highly advantageous, allowing the accurate, quick, and cost effective dispensing of prescription drugs, and simple and effective record keeping. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and structures.

What is claimed is:

1. A method of dispensing prescription drugs, using a label assembly including a release liner having first and second ends, and supporting a first label section having pressure sensitive adhesive engaging the release liner and located adjacent the first end, a second label section having pressure sensitive adhesive engaging the release liner and located adjacent the second end, and at least one central label section having pressure sensitive adhesive engaging the release liner and located between the first and second sections, said method comprising the steps of:

(a) imaging the first label section to include indicia comprising the name of a prescription drug, the dosage for proper administration of the drug, and the quantity of the drug to be provided in a package;

(b) exposing the adhesive of the first label section at two areas thereof widely spaced between the release liner first and second ends while leaving the release liner in place between the two widely spaced areas;

(c) folding the second and central label sections, while attached to the release liner, underneath the release liner at the first label section;

(d) attaching the exposed adhesive areas of the first label section to a package for the drug, to be administered at the dose, and having the quantity, applied to the first label section in step a), so that the entire label assembly is positioned on the package;

(e) detaching at least part of the first label section from the package;

(f) applying prescribing doctor and patient name indicia to the first label section and at least one of the second and central label sections;

(g) detaching the central and second label sections from the first label section;

(h) removing the release liner from the first label section to expose most or all of the adhesive on the first label section; and (i) applying the first label section exposed adhesive to the package and dispensing the package.

2. A method as recited in claim 1 comprising the further steps of removing the release liner from the second label section, and adhesively applying the second label section to a record sheet.

3. A method as recited in claim 1 comprising the further steps of removing the release liner from at least one central label section, and adhesively applying the removed central section to a record sheet.

4. A method as recited in claim 1 wherein steps (d) and (i) are practiced using a vial as the package.

5. A method as recited in claim 1 wherein the second or central label section includes a self contained coating, and wherein step (f) is practiced by impressing indicia on the first label section, which is transferred to the self contained coating and is simultaneously provided on the self contained coating.

6. A method as recited in claim 1 wherein the first label section has a thermosensitive coating, and wherein step (a) is practiced using a thermal printer on the thermosensitive coating.

7. A method as recited in claim 1 comprising the further step, between steps (d) and (e), of shipping the package to a pharmacy, hospital, or other drug dispensing facility, and wherein steps (e)–(i) are practiced at the pharmacy, hospital, or other drug dispensing facility.

8. A method as recited in claim 1 comprising the further step, before step (a), of imaging indicia calling for entry of doctor and patient name on the first and at least one of the second and a central label sections, and wherein step (c) is practiced to position the indicia calling for entry of doctor and patient name on the second or a central label section aligned with and beneath the indicia calling for entry of doctor and patient name on the first label section; and wherein at least one of the second or central label sections have a self-contained coating, and wherein step (f) is practiced by impressing indicia on the first label section, which is transferred to the self contained coating and is simultaneously provided on the self contained coating.

9. A method as recited in claim 1 wherein the label assembly is part of a web, and wherein the release liner has tractor drive holes adjacent the first and second ends thereof; and wherein step (a) is practiced by driving the web through a printer using the tractor drive holes.

10. A label assembly comprising:

a release liner elongated in a first dimension and having first and second ends;

a first label section having pressure sensitive adhesive engaging the release liner and located adjacent, but spaced from, said release liner first end, said first label section also having first and second ends, said first end the closest portion of said first label section to said release liner first end;

a second label section having pressure sensitive adhesive engaging said release liner and located adjacent, but spaced from said release liner second end;

at least one central label section having pressure sensitive adhesive engaging said release liner and located between and distinct from said first and second label sections; and a readily separable end strip portion of said first label section at said first label section first end.

11. A label assembly as recited in claim 10 further comprising indicia comprising the name of a prescription drug, the dosage for proper administration of the drug, and the quantity of the drug to be provided in a package, imaged on said first label section.

12. A label assembly as recited in claim 11 further comprising a first fold line between said second label section and said at least one central label section, or between two central label sections, said second label section and said central label section, and/or the two central label sections, are spaced from each other in said dimension of elongation.

13. A label assembly as recited in claim 12 further comprising indicia calling for entry of doctor and patient name on both said first and second or central label sections, said indicia on said first and second or central sections aligned with each other when said release liner is Z-folded, including at said first fold line.

14. A label assembly as recited in claim 10 further comprising a second fold line in said release liner at said readily separable end strip to allow ready exposure of said adhesive of said end strip; and a third fold line adjacent, but spaced from, said first label section second end, said third fold line closer to said second fold line than is said first label section second end.

15. A label assembly as recited in claim 10 further comprising a thermosensitive coating on said first label section.

16. A label assembly as recited in claim 10 wherein said release liner is part of a web of substantially identical release liners parallel to and adjacent each other, with lines of weakness disposed between said release liners.

17. A label assembly as recited in claim 16 further comprising tractor drive holes disposed in said release liner adjacent said first and second ends thereof and between said first label section and said first end of said release liner, and second label section and said second end of said release liner, respectively.

18. A labeled prescription drug package comprising:

a release liner elongated in a first dimension and having first and second ends;

a first label section having pressure sensitive adhesive engaging the release liner and located adjacent, but spaced from said release liner first end;

a second label section having pressure sensitive adhesive engaging said release liner and located adjacent, but spaced from said release liner second end;

at least one central label section having pressure sensitive adhesive engaging said release liner and located between and distinct from said first and second label sections;

indicia comprising the name of a prescription drug, the dosage for proper administration of the drug, and the quantity of the drug to be provided in a package, imaged on said first label section;

a package containing the quantity of and the type of drug indicated by said indicia; and said label first section secured by two widely spaced areas of adhesive to said package with said second and central label sections folded underneath said first label section release liner and disposed between said package and said first label section.

19. A labeled prescription drug package as recited in claim 18 further comprising indicia calling for entry of doctor and patient name on both said first, and second or central, label sections, said indicia on said first, and second or central, label sections aligned with each other when said release liner is Z-folded.

20. A labeled prescription drug package as recited in claim 18 further comprising a thermosensitive coating on said first label section, said indicia imaged in said thermosensitive coating.

* * * * *

UNITED STATES PATENT AND TRADEMARK OFFICE

CERTIFICATE OF CORRECTION

PATENT NO. : 5,752,723

DATED : May 19, 1998

INVENTOR(S) : Robertson, Chad

It is certified that error appears in the above-identified patent and that said Letters Patent is hereby corrected as shown below:

On the title page, item [73] Assignee: should read -- Moore U.S.A. Inc., Grand Island, N.Y. --

Signed and Sealed this

Eighteenth Day of August, 1998

*Attest:*

BRUCE LEHMAN

*Attesting Officer*

*Commissioner of Patents and Trademarks*